United States Patent [19]

Meyer

[11] Patent Number: 4,958,672

[45] Date of Patent: Sep. 25, 1990

[54] SUSPENSION SYSTEM FOR VERTICAL BLINDS

[76] Inventor: Pieter N. Meyer, Kromme Akkers 1, 4171 BM Herwijnen, Netherlands

[21] Appl. No.: 192,481

[22] Filed: May 11, 1988

[30] Foreign Application Priority Data

Jan. 8, 1988 [NL] Netherlands ..... 8800049

[51] Int. Cl.[5] ..... E06B 9/36

[52] U.S. Cl. ..... 160/168.1; 160/178.1; 160/900

[58] Field of Search ..... 160/168.1, 178.1, 176.1, 160/900, 348, 166.1, 167, 169, 170, 171, 172, 173, 174, 175, 177

[56] References Cited

U.S. PATENT DOCUMENTS

| | | | |
|---|---|---|---|
| 4,122,884 | 10/1978 | Salzmann | 160/168.1 |
| 4,140,169 | 2/1979 | Arena | 160/178.1 |
| 4,214,622 | 7/1980 | Debs | 160/168.1 |
| 4,293,021 | 10/1981 | Arena | 160/176.1 X |
| 4,628,981 | 12/1986 | Ciriaci et al. | 160/168.1 X |
| 4,648,436 | 3/1987 | Oskam | 160/178.1 X |
| 4,657,060 | 4/1987 | Kaucic | 160/176.1 X |
| 4,736,784 | 4/1988 | Boloix | 160/168.1 |

*Primary Examiner*—David M. Purol

*Attorney, Agent, or Firm*—Ralph M. Burton

[57] ABSTRACT

Suspension system for vertical blinds, comprising a track, one side of which is partially open, a non-circular drive rod for adjusting the position of hooks, a number or slides each provided with a sleeve having an internal shape that is adapted to suit the section of the non-circular rod and externally provided with a worm wheel which interacts with a second worm wheel for a suspension hook, in a manner such that the slides are movable along the drive rod and the suspension hooks can be rotated by rotating said drive rod with the aid of a cord placed over a pulley. Means, also operated by a cord pulley with cord, are present for displacing the slides in the longitudinal direction of the track for pushing the blinds to be suspended in and out, respectively. The slides are mutually connected by coupling elements by which the mutual distance of the slide is limited.

The means for displacing the slides (1, 5) are formed by the cord (3, 4) being guided via guide pulleys at one end of the track (20) through the interior of the length of the track, placed over a return pulley at the other end of the track and fastened to the first slide.

Preferably the coupling elements are concertina-like elements of springy material.

4 Claims, 3 Drawing Sheets

SUSPENSION SYSTEM FOR VERTICAL BLINDS

DESCRIPTION OF THE PRIOR ART

The invention relates to a suspension system for vertical blinds.

A suspension system marketed by the assignee for many years comprised a track having an essentially rectangular section, one side of which is partially open, a non-circular drive rod for adjusting the hook position, a number or slides each provided with a sleeve having an internal shape that is adapted to suit the section of the non-circular rod and externally provided with a worm wheel which interacts with a second worm wheel for a suspension hook, in a manner such that the slides are movable along the drive rod and the suspension hooks can be rotated by rotating said drive rod with the aid of a cord pulley located on the rod and a cord placed over it means which are also operated by a cord pulley and cord displace the slides in the longitudinal direction of the track for pushing the blinds to be suspended in and out, respectively. For this purpose the slides are mutually connected by coupling elements which are designed such that the slides can essentially come to rest against one another or may move apart a limited maximum distance.

This prior art system performs excellently and presents no particular problems.

The dimensions of the known system are mainly determined by the fact that two drive rods are present. In addition to the non-circular rod already mentioned for adjusting the hook position, a rod was also used as a means for displacing the slides in the longitudinal direction or the track. This was a so-called torque rod, i.e. a rod having two screw threads at a relatively large angle, interacting with a sleeve which was firmly fitted in the last slide and was provided in its interior with projecting parts within the screw threads of the rod. On rotation of the rod with the aid of the cord the last slide was as a result forced to move, after which the said coupling elements ensured that the other slides followed during opening. The torque rod ran freely through cylindrical openings in the other slides. One drive rod was thus located on one side of the interior space in the track and the other drive rod was located on the other side. The space between them was then essentially occupied by the worm wheel which transmitted the rotating movement of the drive rod for the hook position to the spindle of the hooks. From the point of view of space saving during storage and transport, incidentally, the hooks were supplied loose and had to be fastened in the slide by the user—with the risk, associated therewith, of unsatisfactory fixing, so that a slat of the blinds dropped during suspension. Furthermore, in the known suspension system the coupling elements were located in the space above the torque rod. They were formed by hook-shaped parts made of light, somewhat springy metal. Each coupling element was fixed to one slide and projected with the outstretched remaining part with the hook through a recess in the next slide but, during pushing-in, then also finished up in the corresponding opening in other slides.

THE OBJECTS OF THE INVENTION

The inventor has now set himself the object to construct the system as a whole so as to be more compact and thus also more slimline, as a result of which it better fits in with present trends in interior design.

SUMMARY OF THE INVENTION

The suspension system according to the invention has, in basic principle, the characteristic that the means for displacing the slides are formed by the cord being guided via guide pulleys at one end of the track through the interior of the length of the track, placed over a return pulley at the other end or the track and fastened to the first slide.

As a result of the fact that the known torque rod is now replaced by a cord drive system it is possible to achieve a considerable space saving in the width direction of the track.

A preferred embodiment of the invention has the feature that the cord for displacing the slides is passed along the track on the side on which the drive rod for adjusting the hook position is located and, in particular, above said rods and that the coupling elements are formed by accordion folded strips which are made of springy material and are fixed to the consecutive slides.

In accordance with this idea, the cord is thus present at that position which, in the case of the earlier suspension system, was occupied by the coupling elements, while another solution has now been found for the function of said coupling elements in the form of the accordion-folded strips which do not occupy any extra width. The result of this is that the width of the track can now be reduced to no more than 60% of the width of the track in the earlier system.

This numerical value is also made possible by a design for the slide wherein the rotation spindle for the hook is provided with a worm crown wheel located under the drive rod for adjusting the hook position and in which the rotation spindle for said hook is arranged symmetrically relative to the slide. In the earlier system, the worm wheel which was fastened on the spindle for the hook was located between the two drive rods, i.e., viewed in the vertical direction,next to the non-circular drive rod. Utilizing the said worm crown wheel the result is now achieved that said wheel is located partially beneath the worm wheel driven by the non-circular rod, and this results thus in a space saving in the width direction.

As a result of the said space saving in the width direction of the track it is now no longer troublesome to keep the dimensions in vertical direction somewhat larger, specifically by fixing the hooks to the slides in the factory. This prevents the user from mounting the hooks incorrectly. The overall height dimension of the system—track with hooks—can now be kept smaller than the width of the earlier track, while the width or the new track can be made essentially equal to the height of the earlier track without hooks. The cross-section of the casing required for packaging each individual track can be even smaller, with the hooks mounted, than the cross-section of the casing for packaging the earlier track without the hooks mounted.

SHORT DESCRIPTION OF THE DRAWINGS p

DESCRIPTION OF THE PREFERRED EMBODIMENT

Figure 1:
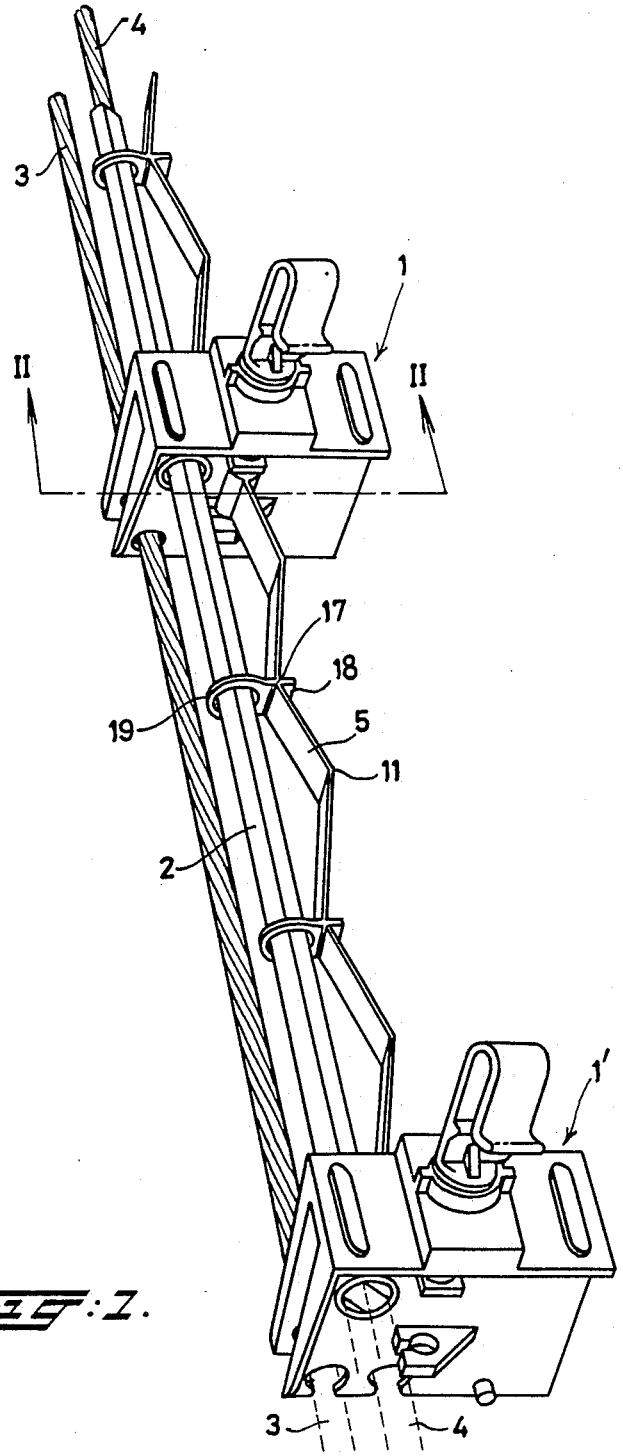
FIG. 1 shows, in perspective, a portion of the mechanism with the track omitted.

Two slides 1, 1' can be seen in FIG. 1. The slides are displaceable along the rod 2. The cord lengths 3, 4 serve to displace the slides. Consecutive slides are mutually connected by a accordion-folded strips 5.

Figure 2:
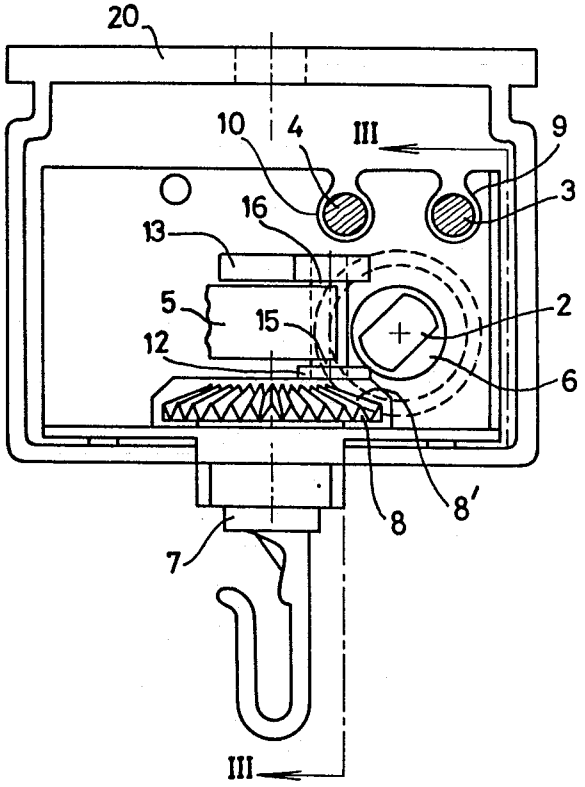
FIG. 2 is a cross-section through a track with the mechanism, at the place indicated by II—II in FIG. 1.
Figure 3:
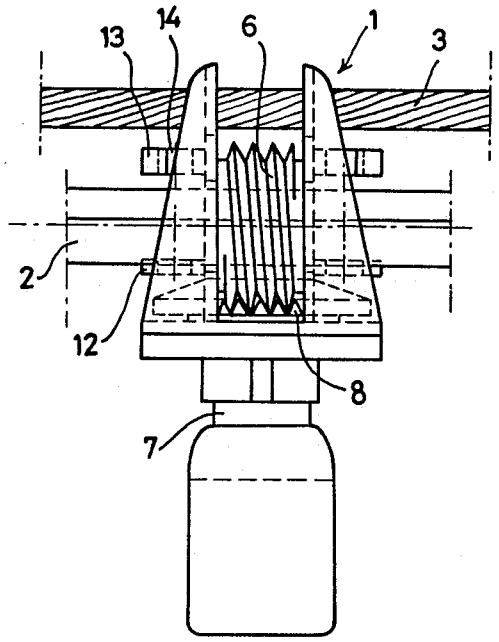
FIG. 3 is a side view of a single slide, taken along arrows III—III in FIG. 2.
Figure 5:
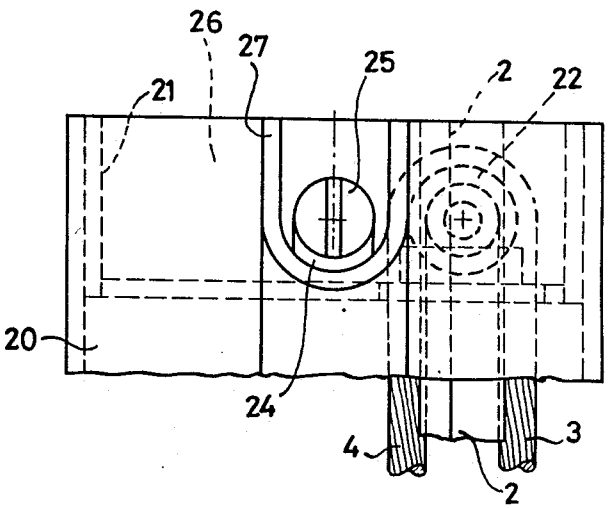
FIG. 5 is a plan view of the single end piece, viewed along arrow V in FIG. 4, the track being omitted.

As can be seen, in particular, in FIG. 2, the rod 2 is a non-circular drive rod 2 for adjusting the hook position. For this purpose, the rod interacts with a worm wheel 6 in each slide 1. According to the invention, in order to translate the rotating movement thereof into a change in the position of the hook body 7 a crown gear wheel 8 is used. Whereas, in the earlier system, a crown gear wheel which was present at the height of the non-circular rod 2 was used for this purpose, said crown wheel 8 is at a lower position. More particularly, the place indicated by 8' in FIG. 2, at which the teeth of the crown wheel 8 interact with the worm of the worm wheel 6 comes to rest against the lower side or the worm wheel 6 instead of next to it. Thus, according to the invention, a space saving is achieved in the width direction, i.e. in the horizontal direction in FIG.2.

The manner in which the hook body 7 is fixed in the worm crown wheel 8 (by a hook body being provided with a pair of spring teeth which are pushed through a rectangular opening in the interior of the wheel 8) does per se not differ from the connection in the earlier system, so that the special features thereof are not shown in the drawing. It is mentioned here, however, that, according to the invention, the hook body 7 may earlier be fixed in the factory in this manner instead of letting the user do the inserting of the hooks.

FIG. 2 also shows, even more clearly than FIG. 1, that the cord lengths 3, 4 are located, relative to the longitudinal central plane of the track, on the same side as the non-circular drive rod 2 and in particular in the space above the rod 2. They are guided through two recesses 9 and 10, respectively, in the slide 1. Narrowed but open connections of said guide-through channels 9, 10 for the cord lengths make it possible that the cords can be pressed easily inwards during assembly and do not need to be threaded through. The cord lengths 3, 4 are fastened to the first slide of the train present in a track—for example, by making knots on either side of said slide—and one of the ends is placed over a return pulley fitted in an end piece on the track. An end piece containing guide rollers for guiding the cord lengths outwards for operation is arranged at the other end of the track; it will be described below. The important point in the inventive concept is the use of cords 3, 4 for displacing the slides, as a replacement for the torque rods hitherto used for this purpose in vertical blinds, which were then also present on the other side or the longitudinal central plane through the track to the non-circular rod 2 for the position of the suspension hooks for the vertical blinds.

FIG. 1, but in particular FIG. 2, shows that the rotation spindle of the crown wheel 8 with the hook body 7 lies in the longitudinal central plane of the slide and that said slide completely covers the width of track 20. As a final result the bodies of the suspension hooks 7 thus lie symmetrically in the width direction of the track.

The coupling elements for the slides, which ensure that the second slide follows at a certain distance when the first is displaced, and so on, preferably are, according to the invention, accordion-folded strips 5 which are best visible in FIG. 1. These are made of plastic material having sufficient elasticity for allowing bending at the bend points 11. They may be manufactured such that in the unloaded state they have the somewhat zigzag-shape shown in FIG. 1. This has the advantage, in comparison with an outstretched undistorted state, that bending in the wrong direction is avoided. The fixing of the accordion-folded strips 5 relative to the slides takes place with the aid of fixing means integrally formed on either side of each of the slides, and in particular a lowermost fixing element 12 which may have the shape of an eye, and an uppermost fixing element 13 which is provided with a slot 14. The two ends of the accordion-folded strips are then provided, on the upper and lower sides, with pin-shaped projections 15 and 16, respectively (see FIG. 2). During assembly, pin 15 can be pushed into a hole in the fixing element 12 while pin 16 can then be pressed sideways through the slot 14 in the element 13. In this state, the pins 15, 16 will no longer have the tendency to leave the openings.

In order to ensure, during movement of the slides towards each other, that the accordion-folded strips 5 bends further in the correct manner, the innermost bend points, such as 17, are pushed into slots in a small flat part 18 which is integrally formed on a ring 19 (see FIG. 1). The rings 19 have a much larger inside diameter than the outside diameter of the drive rod 2, so that they still allow considerable play of the bend points, such as 18, of the strips 5 also in the transverse direction. The rings 19 are pushed on the rod 2 during assembly when the slides, such as 1, 1', are also threaded onto said rod.

Figure 4:
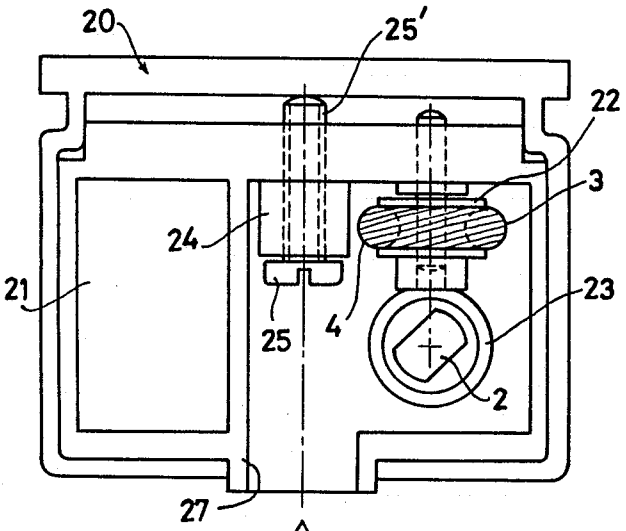
FIG. 4 is an end view looking towards the track with the end piece carrying the return pulley.

FIG. 4 shows an end view of the track in which the end piece 21 carries the return pulley 22 over which the cord 3 is placed. The end piece is provided with a hole 23 through which the drive rod 2 projects in a freely rotating manner.

The end piece 21 furthermore carries a small block 24 which is provided with a screwthread through which a screw 25 projects. An opening 27, which in this case is completely open on one side, but which may also be simply round, is formed in the underside 26. This opening 27 is directly opposite the small block 24. Both are located in the centre, viewed in the width direction, as a result of which they come to rest opposite the opening in the track. In this manner, the head of the screw 25 is always accessible through this opening in the track. By turning the screw, the end 25' comes to rest, as shown in FIG. 4, against the closed face of the section 20, as a result of which the small block 21 can be firmly clamped relative to the track.

An important effect of this type of fixing the end piece 21 is that it permits the user to shorten the track. He can simply loosen the screw 25 and push the small block as far in the arch-shaped track of standard length as is necessary for the precise length dimension of the track required. The cord can then automatically be pulled outwards on the operating end. The drive rod 2 remains in the same position relative to the track 20 and the two last-mentioned parts can be sawn off just outside the small block.

What is claimed is:

1. In a vertical blind suspension system having a track partially open at one side with slides disposed therein and having slat-suspending hooks depending through the partially open side and a non-circular drive rod disposed in the track and connected to the slides in such manner that the slides are movable along the drive rod and the slat suspension hooks are rotated by rotating the drive rod and a cord system disposed within the track and connected to an end slide and operable in opposite directions for displacing the slides along the track;

the suspension system characterized by accordion-folded strips of flexible material having a predetermined length; each of said accordion-folded strips being disposed within the track and connected at opposite ends to each adjacent slide for distension to space said slides apart along said predetermined length and drawing them along the track in response to operation of the cord system in one direction and being collapsible upon themselves to stack the slides together in response to operation of the cord system in the opposite direction; each accordion-folded strip including a plurality of bending points intermediate its opposite ends; and attachement means for loosely slidably attaching at least one of said bending points of said accordion-folded strip to the drive rod for suspension therefrom.

2. The invention defined in claim 1 wherein said drive rod extends within the track along one side thereof and said cord system is disposed within the track on the side where the drive rod is located.

3. The invention defined by claim 1 wherein said attachment means are provided for slidably attaching alternate bends of the accordion-folded strip to the drive rod for suspending the strip therefrom.

4. The invention defined by claim 1 wherein said means comprises a ring loosely encircling the drive rod and connected to the accordion-folded strips.

* * * * *

UNITED STATES PATENT AND TRADEMARK OFFICE

CERTIFICATE OF CORRECTION

PATENT NO. : 4,958,672

DATED : Sep. 25, 1990

INVENTOR(S) : Pieter N. Meyer

It is certified that error appears in the above-identified patent and that said Letters Patent is hereby corrected as shown below:

On the title page, insert the following:

--[73] Allpac Holding B.V.--.

Signed and Sealed this

Sixteenth Day of June, 1992

*Attest:*

*Attesting Officer*

DOUGLAS B. COMER

*Acting Commissioner of Patents and Trademarks*